US006062949A

United States Patent [19]

Yashiki et al.

[11] Patent Number: 6,062,949

[45] Date of Patent: May 16, 2000

[54] POLISHING AMOUNT CONTROL SYSTEM AND METHOD FOR SAME

[75] Inventors: Hiroshi Yashiki; Katsunori Nagao; Takamitsu Shimoide; Akihiko Yamaya, all of Ayase, Japan

[73] Assignee: Speedfam Co., Ltd., Tokyo, Japan

[21] Appl. No.: 09/201,472

[22] Filed: Nov. 30, 1998

[30] Foreign Application Priority Data

Jan. 26, 1998 [JP] Japan ..... 10-029284

[51] Int. Cl.[7] ..... B24B 49/00

[52] U.S. Cl. ..... 451/10; 451/5; 451/6; 451/8; 451/9; 451/262; 451/339

[58] Field of Search ..... 451/5, 6, 8, 9, 451/10, 331, 339, 262, 268, 269, 265, 267, 264

[56] References Cited

U.S. PATENT DOCUMENTS

| | | | |
|---|---|---|---|
| 3,848,365 | 11/1974 | Bovensiepen et al. | 451/28 |
| 5,274,960 | 1/1994 | Karlsrud | 451/259 |
| 5,333,413 | 8/1994 | Hashimoto | 451/9 |
| 5,908,347 | 6/1999 | Nakajima et al. | 451/5 |
| 5,957,749 | 9/1999 | Finarov | 451/6 |
| 5,964,651 | 10/1999 | Hose | 451/262 |

FOREIGN PATENT DOCUMENTS 9-223312 8/1997 Japan .

*Primary Examiner*—David A. Scherbel
*Assistant Examiner*—Shantese McDonald
*Attorney, Agent, or Firm*—Fitch, Even, Tabin & Flannery

[57] ABSTRACT

A polishing amount control system and method for same which can quickly feed back the results of measurement of a coating layer of a workpiece to the next polishing work so as to improve the productivity of the workpieces and further enable high precision polishing work. The thicknesses of the plating layers of the two surfaces of a magnetic disk W polished by a double-side polishing apparatus 1 are measured by an X-ray thickness meter 2. The rotational speeds of the drive motors 15 and 18 of the double-side polishing apparatus 1 are controlled in accordance with the results of the measurement. Specifically, the polishing amounts of the plating layers of the upper surface and lower surface of the magnetic disk W polished next become within 1.8 μm to 2.2 μm by controlling the rotational speeds of the upper platen 13 and the lower platen 11. The thickness difference of the upper and lower surfaces of the same magnetic disk W become within −0.15 μm to +0.15 μm by controlling the rotational speed of one of the upper platen 13 and lower platen 11.

10 Claims, 10 Drawing Sheets

POLISHING AMOUNT CONTROL SYSTEM AND METHOD FOR SAME

BACKGROUND OF THE INVENTION

1. Field of the Invention

The present invention relates to a polishing amount control system for controlling the amount of polishing with respect to the coating layer of a magnetic disk or other workpiece and a method for the same.

2. Description of the Related Art

In general, nickel is a ferromagnetic metal, but becomes nonmagnetic when made an amorphous plating film and incorporating a suitable amount of phosphorus. As one example, there is a nonelectrolytic nickel-phosphorus plating film. A plating film of this nonelectrolytic nickel-phosphorus (hereinafter referred to as "Ni-P") has a high dynamic strength, high corrosion resistance, and, as mentioned above, nonmagnetic property, so as to be suitable for use as a reinforcement film for a magnetic disk etc.

That is, the practice has been to form a layer of a nonelectrolytic Ni-P plating film on both surfaces of a magnetic disk substrate, polish the surface of the plating layer to flatten it, and thereby form a predetermined magnetic disk.

A plating layer of a magnetic disk, however, may be given flatness by polishing to a predetermined thickness. Further, even a plating layer is polished flat, if the thickness of the plating layer on one surface of the magnetic disk differs from the thickness of the plating layer on the other surface, there is liable to be a difference in the properties of the front side of the magnetic disk and the properties of the reverse side of the magnetic disk.

Therefore, in the past, the thicknesses of the plating layers of polished magnetic disks have been measured by an X-ray thickness meter to investigate if the plating layer has been polished to a desired thickness and the difference between the thickness of the plating surface of one surface and the thickness of the plating surface of the other surface has become within a predetermined range. Further, when the polishing conditions change due to roughening of the polishing pads etc. and the plating layers can no longer be polished to the desired thickness, the rotational speeds of the platens, sun gear, etc. of the polishing apparatus have been changed manually to control the amount of polishing of the plating layers.

There were however the following problems with the above method of control of the polishing amount of the related art.

In general, magnetic disks are polished as part of the flow of work. Magnetic disks continue to be polished even when measuring the thicknesses of the plating layers of the polished magnetic disks. Therefore, in the interval between when the thicknesses are measured to when the rotational speeds of the platens etc. of the polishing apparatus are controlled, poorly polished magnetic disks end up being produced.

In practice, the thicknesses are often measured for one or two magnetic disks sampled in batch units (for example, 50 magnetic disks). In some cases, further, the thicknesses are measured only once half a day. In such a case, poorly polished magnetic disks end up being produced in large quantities until the upper platen and lower platen of the polishing apparatus are controlled to a suitable rotational speed.

As opposed to this, it may be considered to wait until the end of the series of work of measuring the plating layers and deciding on the rotational speeds of the upper platen and lower platen before polishing the next work. However, since this work is performed manually, a long time would be required to feed back the results of the measurement to the polishing work and therefore a drop in productivity of the magnetic disks would be induced.

SUMMARY OF THE INVENTION

The present invention was made to solve the above problem and has as its object to provide a polishing amount control system and a method for the same which feeds back the results of measurement of a coating layer of a workpiece quickly to the next polishing work to enable improvement of the productivity of the workpiece and further enable high precision polishing work.

To solve the above problem, one aspect of the invention provides a polishing amount control system comprising: a double-side polishing apparatus for making at least one of a sun gear and internal gear rotate so as to make a carrier holding a workpiece having a coating layer on each of the upper and lower surfaces of its substrate rotate and revolve around the sun gear and so as to polish a lower surface coating layer and an upper surface coating layer of the workpiece by a rotating lower platen and an upper platen rotating while pressing against the workpiece; a thickness measurement apparatus for measuring the thicknesses of the upper surface coating layer and the lower surface coating layer after polishing by the double-side polishing apparatus; and a control apparatus for controlling the rotational speeds of the upper platen and lower platen of the double-side polishing apparatus in accordance with the thicknesses of the upper surface coating layer and lower surface coating layer measured by the thickness measurement apparatus, wherein the control apparatus comprises: an upper platen rotational speed control unit for computing an upper film polishing amount comprising a difference between a thickness of the upper surface coating layer before polishing of the workpiece and a thickness of the upper surface coating layer after polishing measured by the thickness measurement apparatus, outputting a value of the upper surface coating layer after polishing when the upper film polishing amount is within a predetermined allowable range of the polishing amount, raising the rotational speed of the upper platen with respect to the workpiece so that the upper film polishing amount becomes within the allowable range of the polishing amount when the upper film polishing amount is smaller than the allowable range of the polishing amount, and conversely lowering the rotational speed of the upper platen with respect to the workpiece so that the upper film polishing amount becomes within the allowable range of the polishing amount when the upper film polishing amount is larger than the allowable range of the polishing amount; a lower platen rotational speed control unit for computing a lower film polishing amount comprising a difference between a thickness of the lower surface coating layer before polishing of the workpiece and a thickness of the lower surface coating layer after polishing measured by the thickness measurement apparatus, outputting a value of the lower surface coating layer after polishing when the lower film polishing amount is within a predetermined allowable range of the polishing amount, raising the rotational speed of the lower platen with respect to the workpiece so that the lower film polishing amount becomes within the allowable range of the polishing amount when the lower film polishing amount is smaller than the allowable range of the polishing amount, and conversely lowering the rotational speed of the lower platen with respect to the workpiece so that the lower film polishing amount becomes within the allowable range of the polishing amount when the lower film polishing amount is larger than the allowable range of the polishing amount; and a double-side thickness difference adjusting unit for controlling the rotational speed of at least one of the upper platen and lower platen so that the difference of thickness of the two surfaces of the workpiece at the next polishing becomes within the allowable range of thickness when the difference of thickness of the two surfaces, comprising the difference between the value of the upper surface coating layer from the upper platen rotational speed control unit and the value of the lower surface coating layer from the lower platen rotational speed control unit is outside a predetermined allowable range of the thickness.

Due to the above configuration, the upper surface coating layer and the lower surface coating layer of the workpiece are polished by rotation of the upper platen and lower platen of the double-side polishing apparatus, then the thicknesses of the upper surface coating layer and the lower surface coating layer are measured by the thickness measurement apparatus. This being so, in the control apparatus, the rotational speeds of the upper platen and the lower platen are controlled in accordance with the thicknesses of the coating layers measured by the thickness measurement apparatus. That is, due to the upper platen rotational speed control unit of the control apparatus, when the computed amount of polishing of the upper film is smaller or larger than the allowable range of the polishing amount, the rotational speed of the upper platen is raised or lowered so that the polishing amount of the upper film of the workpiece at the next polishing becomes within the allowable range of the polishing amount. Further, due to the lower platen rotational speed control unit of the control apparatus, when the computed amount of polishing of the lower film is smaller or larger than the allowable range of the polishing amount, the rotational speed of the lower platen is raised or lowered so that the polishing amount of the lower film of the workpiece at the next polishing becomes within the allowable range of the polishing amount. Further, when the polishing amount of the upper film and the polishing amount of the lower film are within the allowable range of the polishing amount, the double-side thickness difference adjusting unit judges if the difference of thickness of the two surfaces is outside of the allowable range of the difference of thickness. When outside the allowable range of the difference of thickness, the rotational speed of at least one of the upper platen and the lower platen is controlled so that the difference of thickness of the two surfaces of the workpiece at the next polishing becomes within the allowable range of the difference of thickness.

The thickness measurement apparatus in the invention, however, need only be able to measure the thicknesses of the upper surface coating layer and lower surface coating layer. As an example, the thickness measurement apparatus is an X-ray thickness meter.

According to this configuration, it is possible to measure the thicknesses of the upper surface coating layer and the lower surface coating layer at a high precision.

Further, as the workpiece, it is possible to use a disk or wafer or various other members. As an example, the workpiece is a magnetic disk having a nickel-phosphorus plated layer as a coating layer on each of the upper and lower surfaces of a magnetic disk substrate.

Further, the allowable range of the polishing amount and the allowable range of the difference of thickness may be determined in consideration of the flatness of the coating layer etc. As an example, the allowable range of the polishing amount is 1 $\mu$m to 5 $\mu$m and the allowable range of the difference of thickness is −0.15 $\mu$m to +0.15 $\mu$m.

Further, to solve the above problems, the other aspect of the invention provides a polishing amount control system comprising: a double-side polishing apparatus for polishing the two surfaces of a workpiece; a weight measurement apparatus for measuring the weight of a workpiece after polishing by the polishing apparatus; and a control apparatus for controlling the polishing time of the polishing apparatus in accordance with the weight measured by the weight measurement apparatus, wherein the control apparatus computes the difference in weight between the workpiece before polishing and the workpiece after polishing measured by the weight measurement apparatus, lengthens the polishing time of the polishing apparatus so that the difference of weight of the workpiece at the next polishing becomes within an allowable range of the weight when the difference of weight is smaller than a predetermined allowable range of weight, and conversely shortens the polishing time of the polishing apparatus so that the difference of weight at the next polishing becomes within the allowable range of the weight when the difference of weight is larger than the allowable range of weight.

Due to this configuration, the both surfaces of the workpiece are polished by the double-side polishing apparatus, then the weight is measured by the weight measurement apparatus and the polishing time of the polishing apparatus is controlled by the control apparatus in accordance with the computed weight difference. That is, when the weight difference is smaller or larger than the allowable range of the weight, the polishing time of the polishing apparatus is adjusted so that the weight difference of the workpiece at the next polishing becomes within the allowable range of the weight.

Note that while the present invention is a polishing amount control system comprising a product invention, a method enabling achievement of this system may also be considered as an invention.

Therefore, further aspect of the invention provides a polishing amount control method comprising: a double-side polishing step for simultaneously polishing a lower surface coating layer and an upper surface coating layer of a workpiece by a double-side polishing apparatus; a thickness measurement step for measuring the thicknesses of the upper surface coating layer and the lower surface coating layer of the workpiece after the double-side polishing step; and a control step for controlling the rotational speeds of the upper platen and lower platen of the double-side polishing apparatus in accordance with the thicknesses of the upper surface coating layer and lower surface coating layer measured by the thickness measurement apparatus, wherein the control step comprises: an upper platen rotational speed control step for computing an upper film polishing amount comprising a difference between a thickness of the upper surface coating layer before polishing of the workpiece and a thickness of the upper surface coating layer after polishing measured in the thickness measurement step, outputting a value of the upper surface coating layer after polishing when the upper film polishing amount is within a predetermined allowable range of the polishing amount, raising the rotational speed of the upper platen with respect to the workpiece so that the upper film polishing amount becomes within the allowable range of the polishing amount when the upper film polishing amount is smaller than the allowable range of the polishing amount, and conversely lowering the rotational speed of the upper platen with respect to the workpiece so that the upper film polishing amount becomes within the allowable range of the polishing amount when the upper film polishing amount is larger than the allowable range of the polishing amount; a lower platen rotational speed control step for computing a lower film polishing amount comprising a difference between a thickness of the lower surface coating layer before polishing of the workpiece and a thickness of the lower surface coating layer after polishing measured by the thickness measurement step, outputting a value of the lower surface coating layer after polishing when the lower film polishing amount is within a predetermined allowable range of the polishing amount, raising the rotational speed of the lower platen with respect to the workpiece so that the lower film polishing amount becomes within the allowable range of the polishing amount when the lower film polishing amount is smaller than the allowable range of the polishing amount, and conversely lowering the rotational speed of the lower platen with respect to the workpiece so that the lower film polishing amount becomes within the allowable range of the polishing amount when the lower film polishing amount is larger than the allowable range of the polishing amount; and a double-side thickness difference adjusting step for controlling the rotational speed of at least one of the upper platen and lower platen so that the difference of thickness of the two surfaces of the workpiece at the next polishing becomes within the allowable range of thickness when the difference of thickness of the two surfaces, comprising the difference between the value of the upper surface coating layer output in the upper platen rotational speed control step and the value of the lower surface coating layer output at the lower platen rotational speed control step is outside a predetermined allowable range of the thickness. Further, the aspect of the invention of claim 7 comprises a polishing amount control method as set forth in claim 6, wherein in the thickness measurement step, the thicknesses of the upper surface coating layer and the lower surface coating layer are measured by an X-ray thickness meter.

Further, the aspect of the invention comprises a polishing amount control method, wherein in the double-side polishing step, a magnetic disk having a nickel-phosphorus plated layer as a coating layer on each of the upper and lower surfaces of a magnetic disk substrate is polished.

Further, the aspect of the invention comprises a polishing amount control method, wherein in the upper platen rotational speed control step and in the lower platen rotational speed control step, an allowable range of the polishing amount of 1 $\mu$m to 5 $\mu$m is set and in the double-side thickness difference adjusting step, an allowable range of the difference of thickness of −0.15 $\mu$m to +0.15 $\mu$m is set.

Further, the aspect of the invention comprises a polishing amount control method comprising: a double-side polishing step for polishing the both surfaces of a workpiece by a double-side polishing apparatus; a weight measurement step for measuring the weight of a workpiece after the double-side polishing step; and a control step for controlling the polishing time of the polishing apparatus in accordance with the weight measured by the weight measurement step, wherein the control step computes the difference in weight between the workpiece before polishing and the workpiece after polishing measured at the weight measurement step, lengthens the polishing time of the polishing apparatus so that the difference of weight of the workpiece at the next polishing becomes within an allowable range of the weight when the difference of weight is smaller than a predetermined allowable range of weight, and conversely shortens the polishing time of the polishing apparatus so that the difference of weight at the next polishing becomes within the allowable range of the weight when the difference of weight is larger than the allowable range of weight.

BRIEF DESCRIPTION OF THE DRAWINGS

The above and other objects, features, and advantages of the present invention will become more readily apparent from the following detailed description of a presently preferred embodiment of the invention taken in conjunction with the accompanying drawings, in which.

DESCRIPTION OF THE PREFERRED EMBODIMENTS

Below, embodiments of the invention will be explained next with reference to the drawings.

First Embodiment

Figure 1:
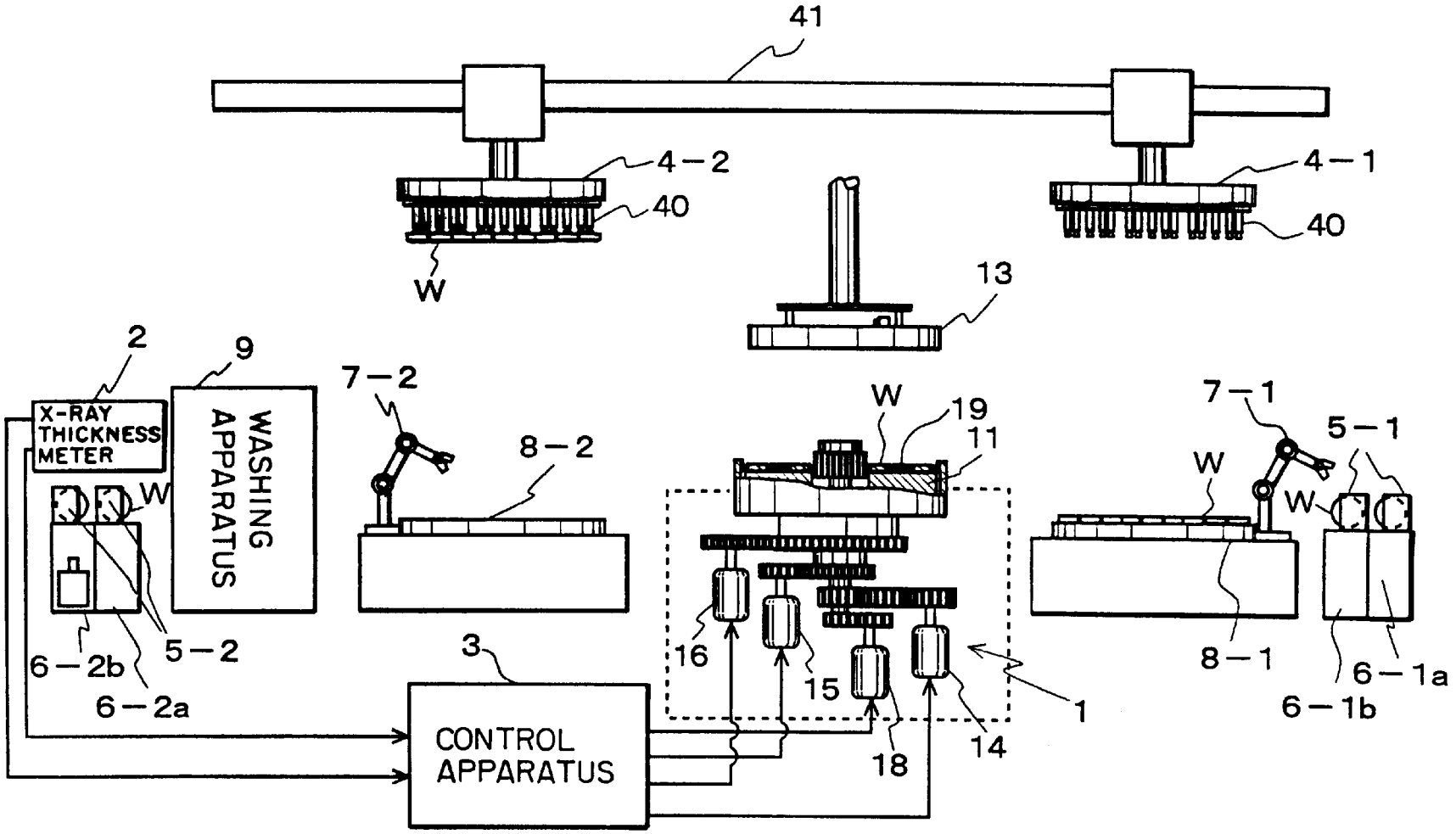
FIG. 1 is a schematic front view of a polishing amount control system according to a first embodiment of the present invention.
Figure 2:
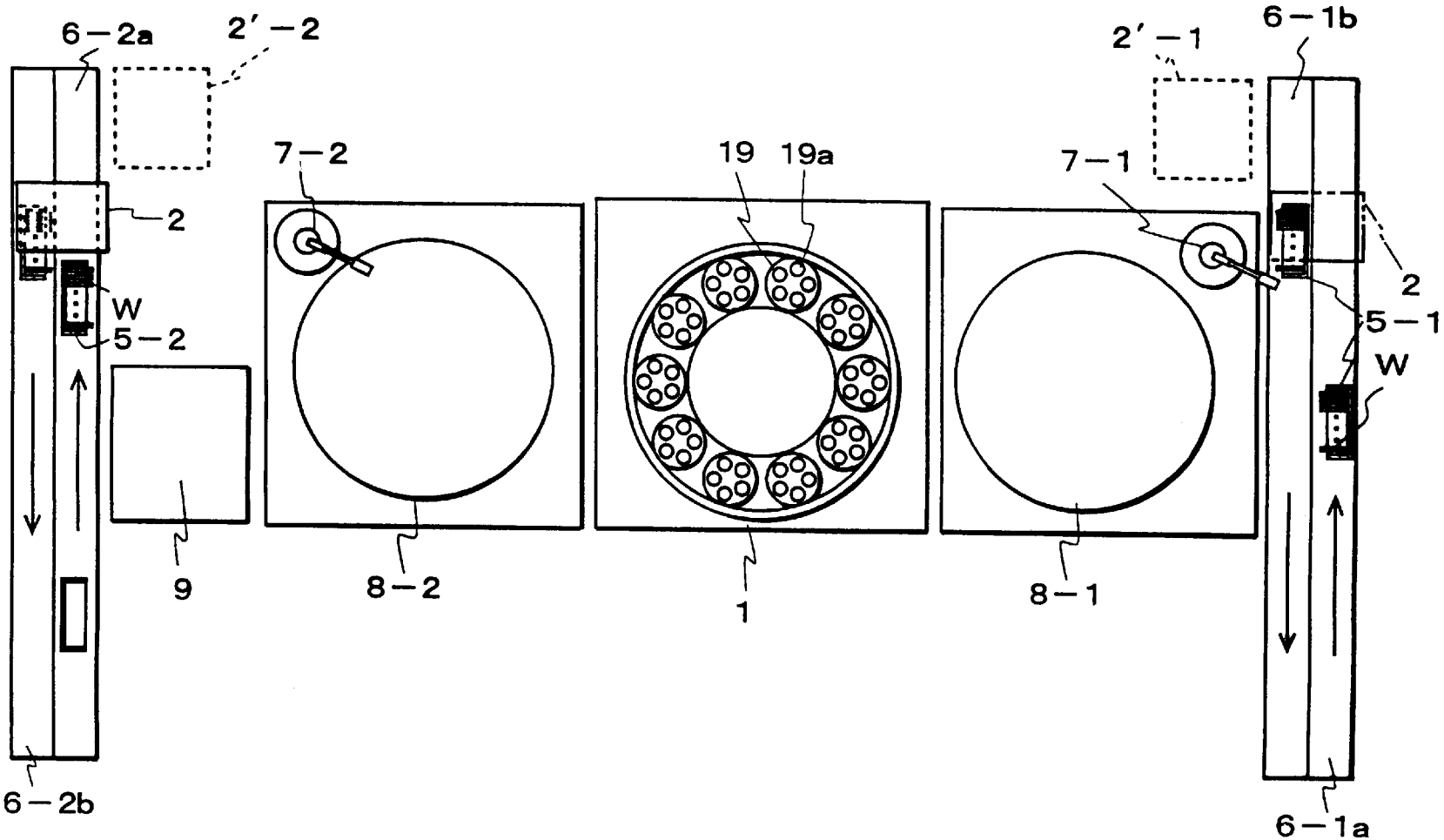
FIG. 2 is a plan view of the system of FIG. 1.

FIG. 1 is a schematic front view of a polishing amount control system according to a first embodiment of the present invention, while FIG. 2 is a plan view of the system of FIG. 1.

As shown in FIG. 1 and FIG. 2, the polishing amount control system is provided with a double-side polishing apparatus 1, an X-ray thickness meter 2 serving as the thickness measurement apparatus, and a control apparatus 3.

The double-side polishing apparatus 1 is an apparatus which simultaneously polishes both surfaces of a magnetic disk W serving as the workpiece.

Figure 3:
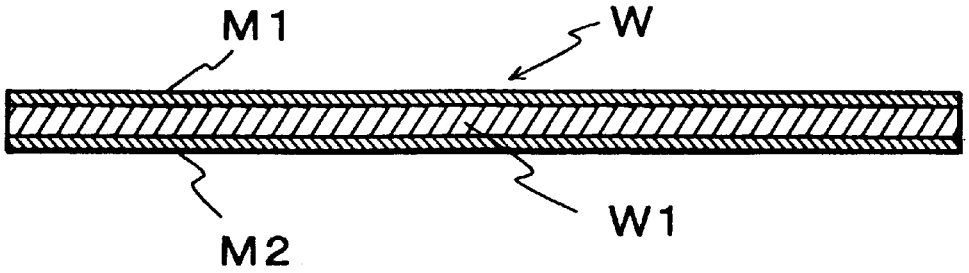
FIG. 3 is a schematic sectional view of a magnetic disk polished by a double-side polishing apparatus.

FIG. 3 is a schematic sectional view of a magnetic disk W polished by the double-side polishing apparatus 1.

As shown in FIG. 3, the magnetic disk W has nonelectrolytic Ni-P plating layers M1 and M2 (upper surface coating layer and lower surface coating layer) as coating layers on the top and bottom surfaces of a magnetic disk substrate W1. The double-side polishing apparatus 1 polishes the plating layers M1 and M2 to desired thicknesses.

Figure 4:
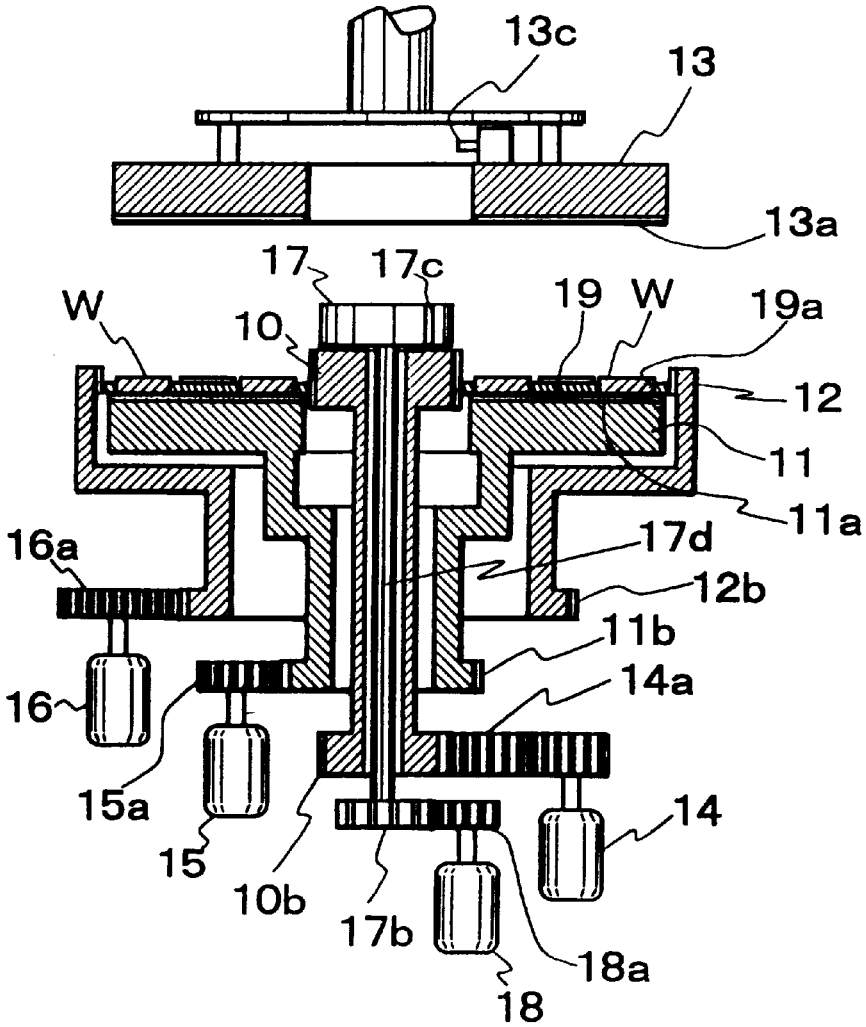
FIG. 4 is a sectional view of the structure of a double-side polishing apparatus.

FIG. 4 is a sectional view of the structure of the double-side polishing apparatus 1.

The double-side polishing apparatus 1 is a known polishing apparatus structured having a concentrically assembled sun gear 10, lower platen 11, and internal gear 12 and having an upper platen 13 on this assembly.

Specifically, a lower platen 11 having a polishing pad 11*a* is arranged at the outer circumference of the central sun gear 10, and internal gear 12 is further arranged at the outer circumference of the lower platen 11. Gears 14*a* to 16*a* for transmitting the rotation of the motors 14 to 16 to the sun gear 10, lower platen 11, and internal gear 12 are engaged with the gear teeth 10*b* to 12*b* provided at the bottom ends of the sun gear 10, lower platen 11, and internal gear 12.

Further, a driver 17 affixed to the top end of a shaft 17*d* inserted in a central hole of the sun gear 10 and having a groove 17*c* on its surface is arranged on the sun gear 10. When the upper platen 13 is descending, the groove 17*c* engages with a hook 13*c* at the upper platen 13 side. Further, a gear 18*a* for transmitting the rotation of the motor 18 to the driver 17 is engaged with the gear teeth 17*b* provided at the lower end of the shaft 17*d* of the driver 17.

Due to this, by setting a magnetic disk W in a workpiece holding hole 19*a* of a carrier 19 placed on the polishing pad 11*a* of the lower platen 11 and engaged with the sun gear 10 and internal gear 12 and driving the motors 14 to 16 and 18, the carrier 19 revolves around the sun gear 10 while rotating, so the plating layer M1 of the magnetic disk W is polished by the polishing pad 13*a* of the rotating upper platen 13 and the plating layer M2 is polished by the polishing pad 11*a* of the rotating lower platen 11.

In this embodiment, as shown in FIG. 1, an unpolished magnetic disk W is set in the workpiece holding hole 19*a* of the carrier 19 of the double-side polishing apparatus 1 by a loader 4-1 (see FIG. 2 and FIG. 4).

That is, a cassette 5-1 storing one batch (for example, 50 sheets) of unpolished magnetic disks W is conveyed by a conveyor 6-1*a* and transferred to a conveyor 6-1*b* by a not shown transfer apparatus. A robot arm 7-1 then removes the batch of magnetic disks W from the cassette 5-1 and places them on an carrying-in table 8-1. Fifty chucks 40 of the loader 4-1 grip the magnetic disks W on the carrying-in table 8-1, then the loader 4-1 travels along a rail 41 to directly above the lower platen 11 of the double-side polishing apparatus 1, brings the held magnetic disks W close to the 10 carriers 19 each having five workpiece holding holes 19*a*, and sets the magnetic disks W inside the workpiece holding holes 19*a*.

Further, an unloader 4-2 removes the magnetic disks W from the workpiece holding holes 19*a* of the carriers 19.

That is, the 50 chucks 40 of the unloader 4-2 grip the polished magnetic disks W in the workpiece holding holes 19*a*, move them to the carrying-out table 8-2, then place them on it. This being done, the robot arm 7-2 successively transfers the magnetic disks W on the carrying-out table 8-2 to a washing apparatus 9. The washing apparatus 9 successively washes the 50 magnetic disks W, then stores the magnetic disks W in a cassette 5-2 on a conveyor 6-2*a*. The cassette 5-2 storing the 50 magnetic disks W is transferred to a conveyor 6-2*b* by a not shown transport apparatus, then is conveyed to a predetermined location by the conveyor 6-2*b*.

The X-ray thickness meter 2 is for measuring the thicknesses of the plating layers M1 and M2 of the magnetic disk W.

Figure 5:
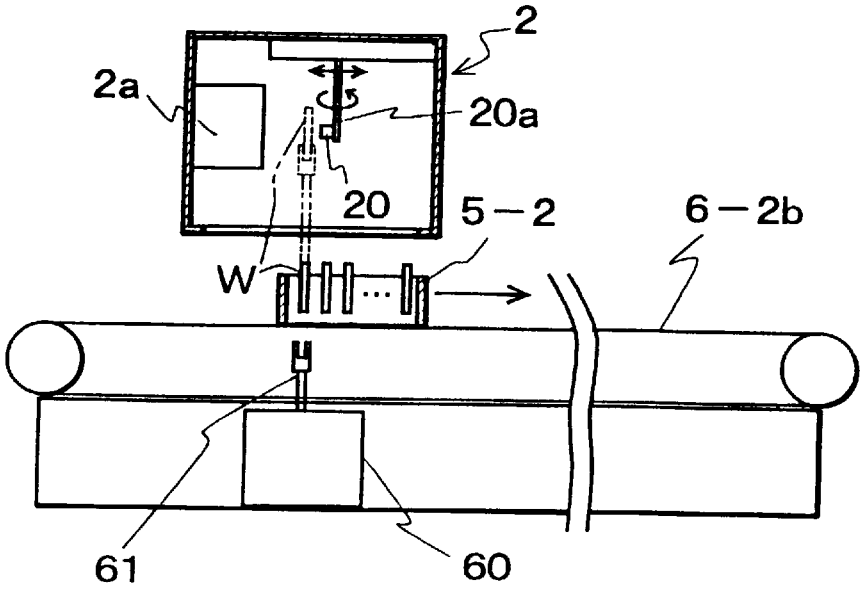
FIG. 5 is a sectional view of the state of arrangement of an X-ray thickness meter.

The X-ray thickness meter 2, as shown in FIG. 5, is arranged above the conveyor 6-2*b* and measures the magnetic disk W raised by a lever 61 of a push-up unit 60 provided below the conveyor 6-2*b*.

Specifically, when the cassette 5-2 conveyed by the conveyor 6-2*b* reaches directly above the push-up unit 60, the conveyor 6-2*b* is made to stop and the lever 61 extends out from a clearance of one of the conveyor belts (not shown) constituting the conveyor 6-2*b*. Further, the 50th magnetic disk W is made to rise held by the lever 61 and, as shown by the two-dot broken line in FIG. 5, enters into the X-ray thickness meter 2. The X-ray thickness meter 2 slides laterally in FIG. 5 and has a chuck 20 which can rotate about a shaft 20*a*. The chuck 20 picks up the magnetic disk W by suction, then positions the magnetic disk W at a predetermined position with respect to the X-ray thickness meter body 2*a*.

Figure 6:
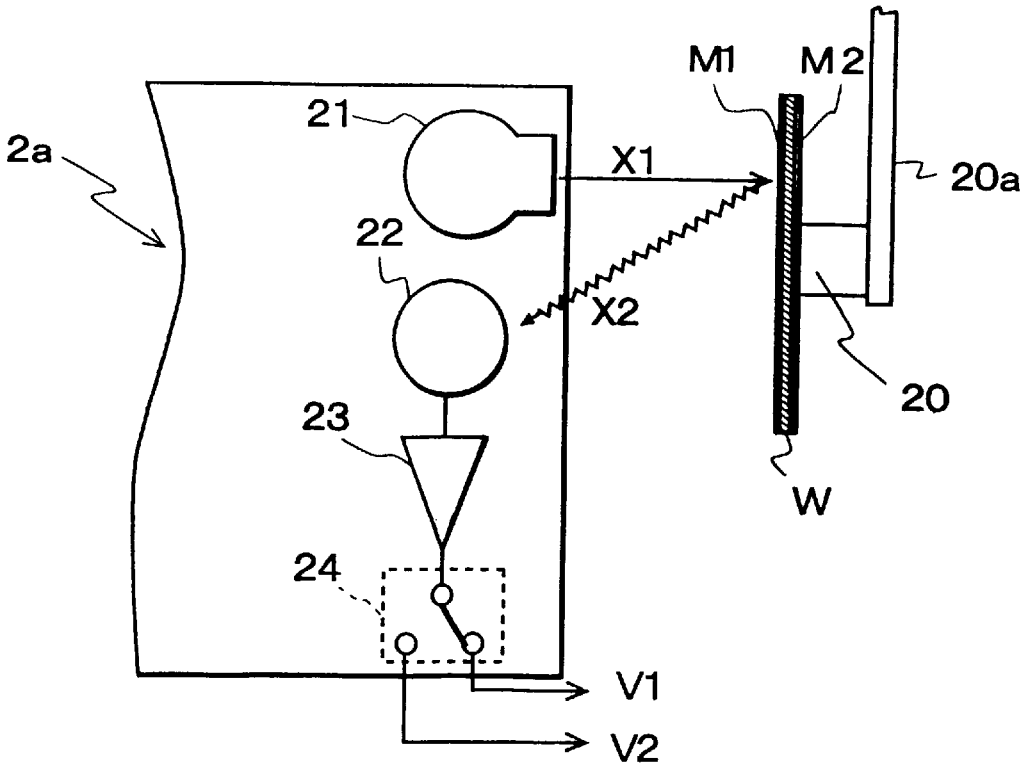
FIG. 6 is a schematic view of the X-ray thickness meter body.

FIG. 6 is a schematic view of the X-ray thickness meter body 2*a*.

The X-ray thickness meter body 2*a*, as shown in FIG. 6, has an X-ray tube 21, a detector 22, and an amplifier 23.

Due to this, when an X-ray X1 is irradiated from for example the X-ray tube 21 to the plating layer M1, a fluorescent X-ray X2 of an amount in accordance with its thickness is radiated from the surface of the plating layer M1 and detected by the detector 22. A voltage V1 corresponding to the amount of the fluorescent X-ray X2, that is, the thickness of the plating layer M1, is produced by the detector 22, amplified by the amplifier 23, and then output. Further, the chuck 20 slides in a direction away from the X-ray thickness meter body 2*a* and rotates and positions the magnetic disk W at the above predetermined position in a state with the plating layer M2 facing the X-ray thickness meter body 2*a*. As a result, the thickness of the plating layer M2 is also detected by the X-ray tube 21 and detector 22 and output as the voltage V2 from the amplifier 23. Note that a selector 24 is provided at the output side of the amplifier 23. The voltages V1 and V2 are output successively to the control apparatus 3 by switching of the selector 24.

When the thickness finishes being measured, the suction on the magnetic disk W is released and the lever 61 shown in FIG. 5 holding the magnetic disk W contracts and is pulled into the push-up unit 60 side. Due to this, the magnetic disk W is returned to the cassette 5-2, the conveyor 6-2*b* simultaneously starts to move, and the cassette 5-2 storing the polished magnetic disks W is conveyed out.

The control apparatus 3 is an apparatus for controlling the rotational speeds of the upper platen 13 and lower platen 11 of the double-side polishing apparatus 1 in accordance with the thicknesses of the plating layers M1 and M2 indicated by the voltages V1 and V2 from the X-ray thickness meter 2.

Figure 7:
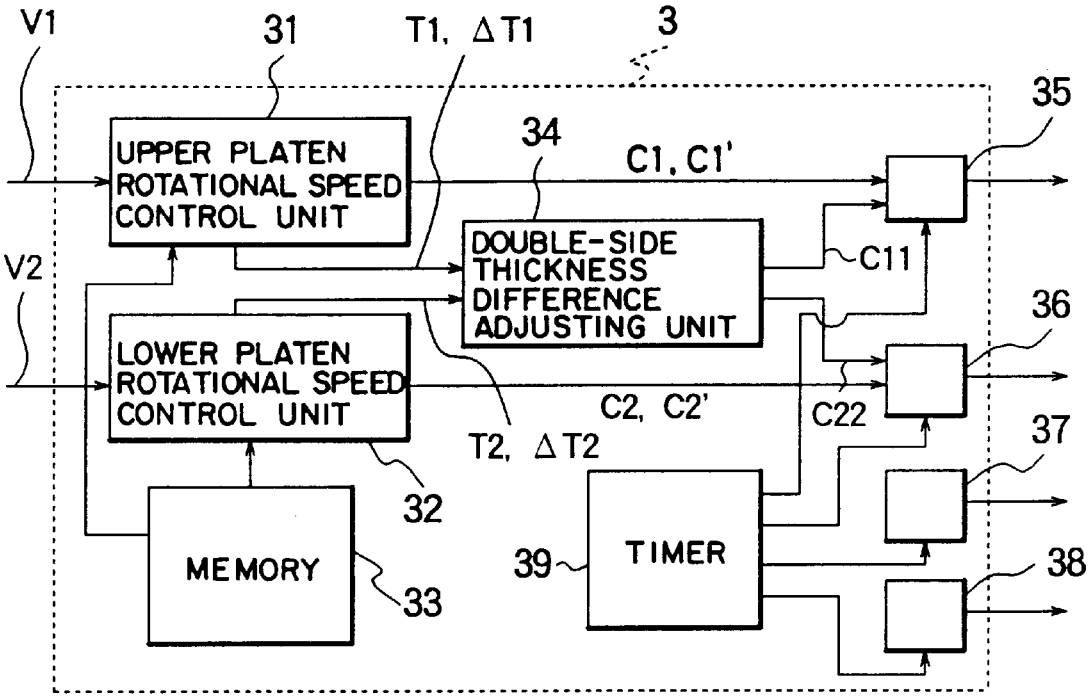
FIG. 7 is a block diagram of a control apparatus.
Figure 8:
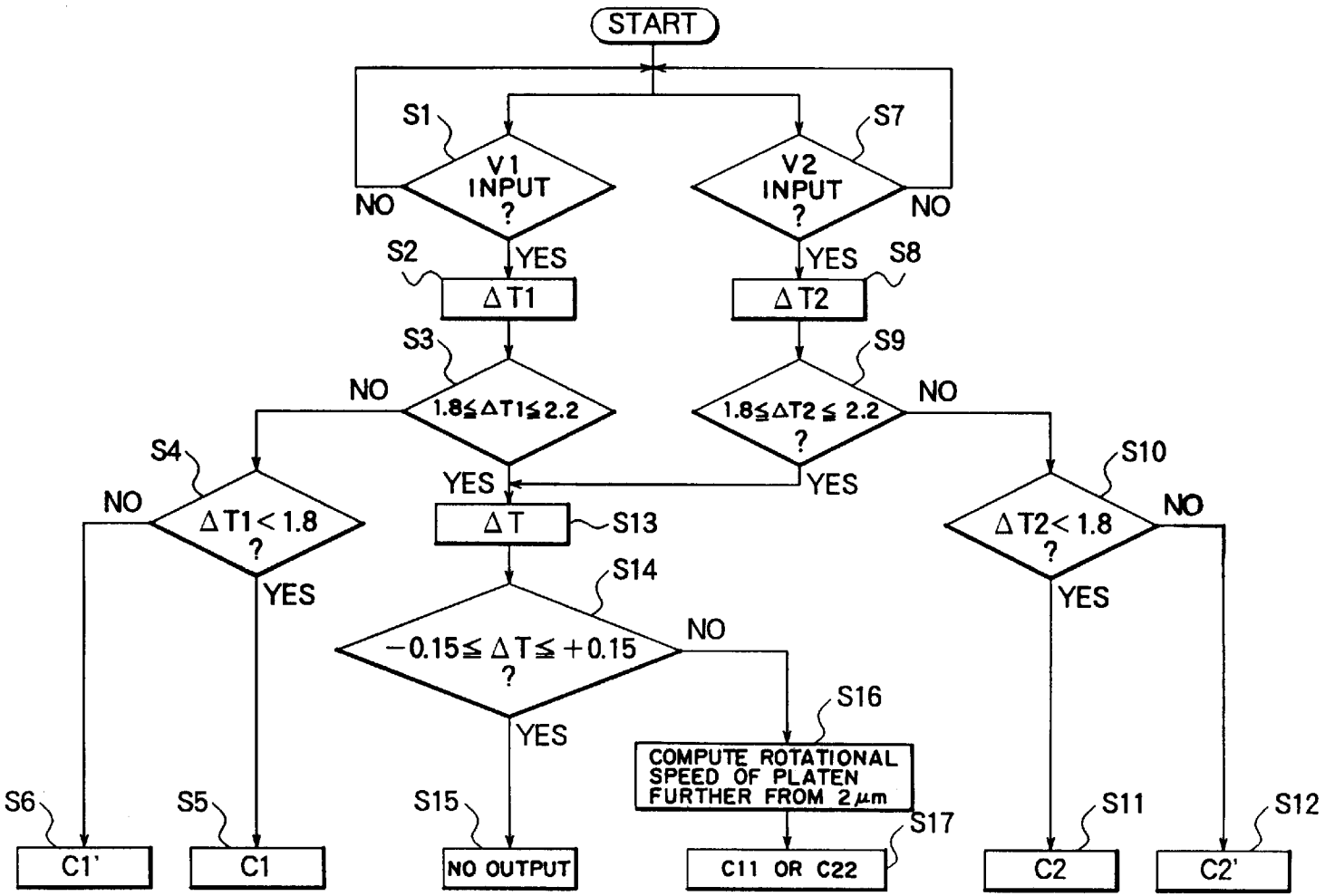
FIG. 8 is a flow chart of the functions of the control apparatus.
Figure 9:
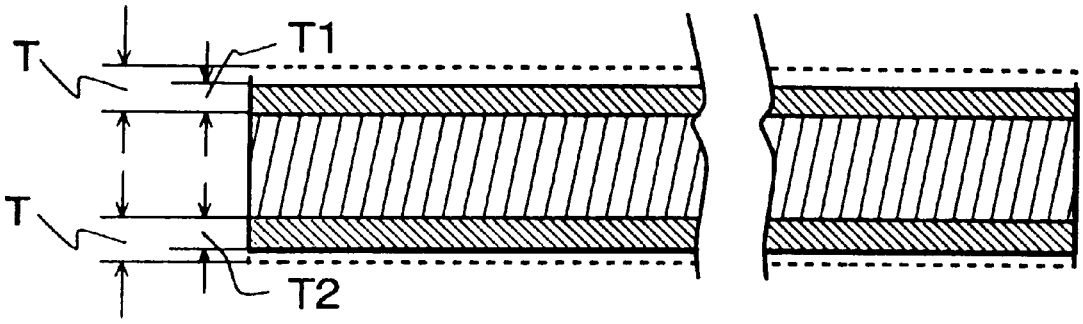
FIG. 9 is a schematic sectional view of the state of the magnetic disk after polishing.

FIG. 7 is a block diagram of the control apparatus 3, FIG. 8 is a flow chart of the functions of the control apparatus 3, and FIG. 9 is a sectional view of the state of the magnetic disk W after polishing.

The control apparatus 3, as shown in FIG. 7, has an upper platen rotational speed control unit 31, a lower platen rotational speed control unit 32, a memory 33, a double-side thickness difference adjusting unit 34, motor drive units 35, 36, 37, and 38 for driving the motors 18, 15, 16, and 14, and a timer 39 controlling the operating time of the motor drive units 35 to 38 as functional blocks.

The upper platen rotational speed control unit 31 has the function of computing the amount of polishing of the upper film comprising the difference of the thickness of the plating layer M1 before polishing and thickness after polishing indicated by the voltage V1 input from the X-ray thickness meter 2.

The thickness T of the plating layers M1 and M2 before polishing shown by the broken line in FIG. 9 is assumed to be substantially constant in all magnetic disks W. The value of the thickness T is stored in advance in a memory 33.

The upper platen rotational speed control unit 31 computes the polishing amount ΔT1 (amount of polishing of upper film) comprising the difference of the thickness T1 of the plating layer M1 indicated by the voltage V1 and the thickness T of the plating layer M1 before polishing read from the memory 33 (step S2 in FIG. 8). Next, it is judged if the polishing amount ΔT1 is a value in the preset allowable range of the polishing amount of 1.8 μm to 2.2 μm (step S3 in FIG. 8). When the polishing amount ΔT1 is out of the above allowable range of the polishing amount (NO in step 3 of FIG. 8), the control signal C1 (or C1') changing the rotational speed of the upper platen 13 is output to the motor drive unit 35.

Here, the allowable range of the polishing amount was set to 1.8 μm to 2.2 μm based on the fact that the target value of the polishing amount ΔT1 is 2 μm and the error is plus or minus 10%.

Note that in this embodiment, the timer 39 is set to 3 minutes and the motor drive units 35 to 38 are made to operate at 3 minute intervals.

The above control will be explained in detail below based on FIG. 10.

Figure 10:
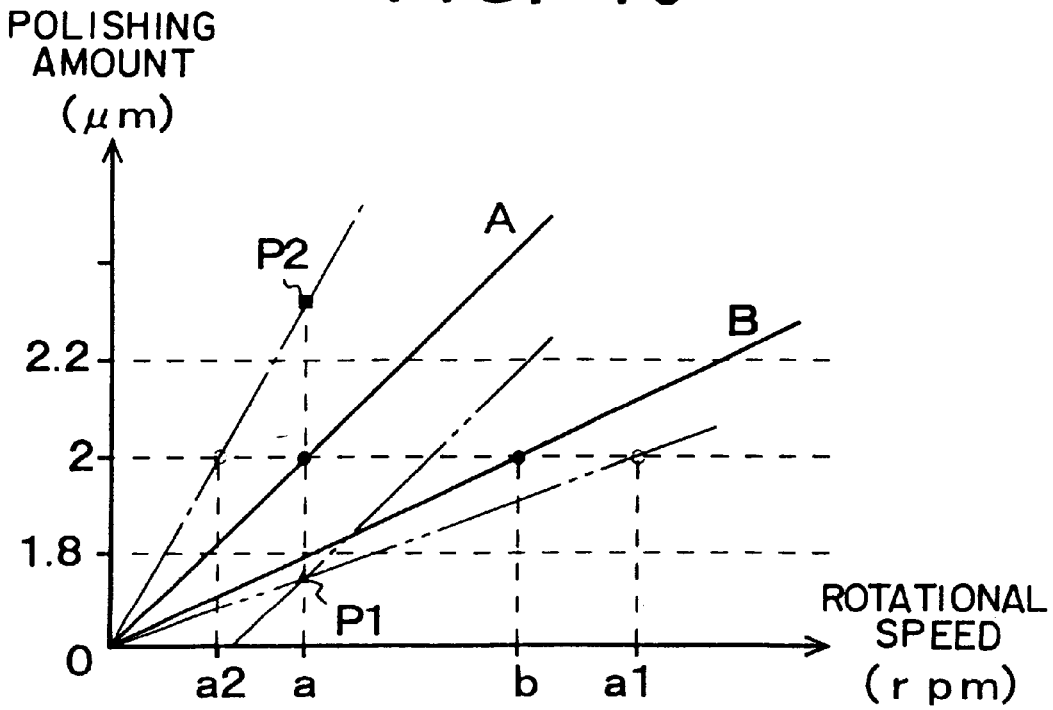
FIG. 10 is a graph for explaining the method of control of the rotational speed of an upper platen.

The correspondence between the rotational speed (rpm) of the upper platen 13 and the lower platen 11 and the polishing amount of the plating layer (μm) when the double-side polishing apparatus 1 performs the polishing work for exactly 3 minutes in the initial state can be determined in advance, so the relationship is tabularized and stored in the memory 33 as shown by the solid lines A and B in FIG. 10. Note that the solid line A shows the relationship between the rotational speed of the upper platen 13 and the polishing amount of the plating layer M1, while the solid line B shows the relationship between the rotational speed of the lower platen 11 and the polishing amount of the plating layer M2. Further, in the initial state, the rotational speeds a and b of the upper platen 13 and lower platen 11 are set so that the polishing amounts of the plating layers M1 and M2 become the target value 2 μm by 3 minutes' polishing work.

In this state, as shown by the point P1 in FIG. 10, when the polishing amount ΔT1 is smaller than 1.8 μm, the upper platen rotational speed control unit 31 finds the rotational speed a1 for making the polishing amount ΔT1 2 μm and outputs the control signal C1 for raising the upper platen 13 to this rotational speed a1 to the motor drive unit 35 (YES in step S4 of FIG. 8, S5). Specifically, as shown by the two-dot broken line in FIG. 10, the line passing through the origin and the point P1 is found and the rotational speed a1 of the point corresponding to the polishing amount 2 μm on that line is found.

Further, as shown by the point P2 in FIG. 10, when the polishing amount ΔT1 is larger than 2.2 μm, as shown by the one-dot broken line, the line passing through the origin and the point P2 is found and the rotational speed a1 corresponding to 2 μm on that line is found. Further, a control signal C1' for lowering the upper platen 13 to the rotational speed a2 is output to the motor drive unit 35 (NO of step S4 in FIG. 8, S6).

On the other hand, the lower platen rotational speed control unit 32 also performs similar control as with the upper platen rotational speed control unit 31 for the lower platen 11.

That is, when the voltage V2 from the X-ray thickness meter 2 is input (YES in step S7 of FIG. 8), the polishing amount ΔT2 (polishing amount of lower film) comprising the difference between the thickness T2 of the plating layer M2 and the thickness T before polishing is computed (step S8 of FIG. 8) and it is judged if the polishing amount ΔT2 is within 1.8 μm to 2.2 μm (step S9 in FIG. 8).

Figure 11:
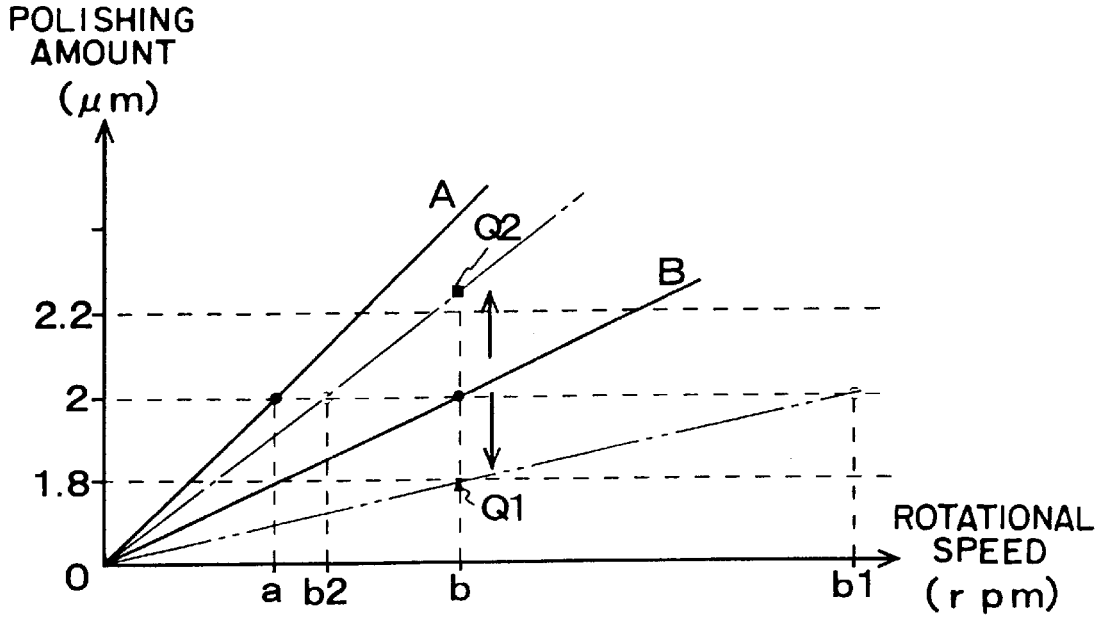
FIG. 11 is a graph for explaining the method of control of the rotational speed of a lower platen.

Further, as shown by the point Q1 of FIG. 11, when the polishing amount ΔT2 is smaller than 1.8 μm, as shown by the two-dot broken line, the line passing through the origin and the point Q1 is found and the rotational speed b1 corresponding to the polishing amount 2 μm on the line is found. Further, a control signal C2 for raising the lower platen 11 to the rotational speed b1 is output to the motor drive unit 36 (NO at step S9 in FIG. 8, YES at step S10, S11).

Further, as shown at the point Q2 in FIG. 11, when the polishing amount ΔT2 is larger than 2.2 μm, as shown by the one-dot broken line in FIG. 11, the line passing through the origin and the point Q2 is found, and a control signal C2' for lowering to the rotational speed b2 of the point corresponding to 2 μm on the line is output to the motor drive unit 36 (NO at step S10 in FIG. 8, S12).

Further, when the polishing amounts ΔTI and ΔT2 of the plating layers M1 and M2 are both within 1.8 μm to 2.2 μm (YES at step S3 in FIG. 8, YES at S9), the thickness T1 and polishing amount ΔT1 of the plating layer M1 and the thickness T2 and polishing amount ΔT2 of the plating layer M2 are input from the upper platen rotational speed control unit 31 and the lower platen rotational speed control unit 32 to the double-side thickness difference adjusting unit 34.

Next, the double-side thickness difference adjusting unit 34 computes the thickness difference ΔT (difference of thicknesses of both sides) comprising the difference between the thickness T1 of the plating layer M1 and the thickness T2 of the plating layer M2 and judges if that thickness difference ΔT is within the preset allowable range of the thickness of −0.15 μm to +0.15 μm (S13 and S14 in FIG. 8).

Further, when the thickness difference ΔT is within −0.15 μm to +0.15 μm, no control signal is output (YES at step S14 in FIG. 8, S15).

As opposed to this, when the thickness difference ΔT is out of the range of −0.15 μm to +0.15 μm, the rotational speed of the platen furthest from the polishing amount of 2 μm is controlled (NO at step S14 in FIG. 8, S16).

Figure 12:
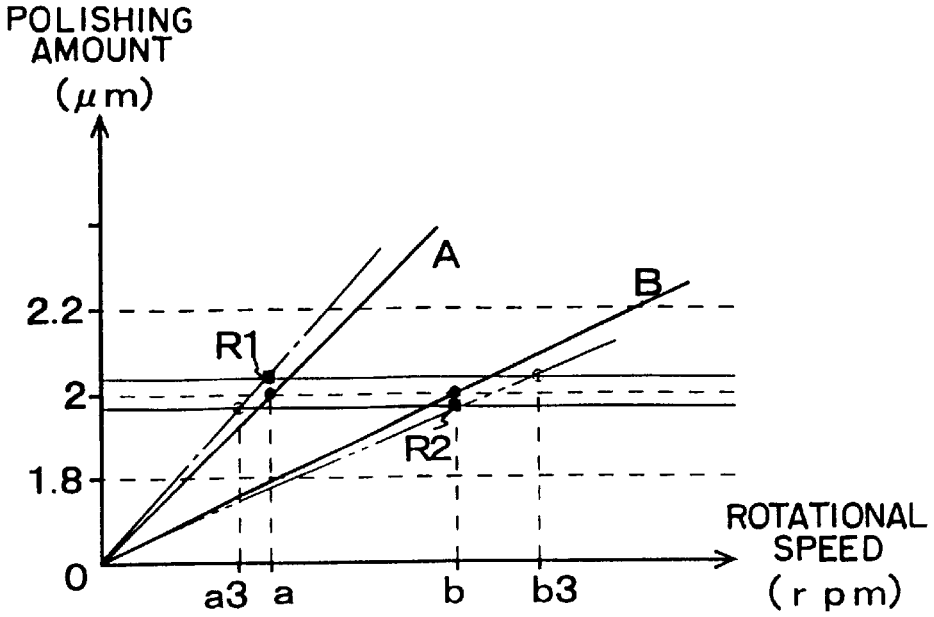
FIG. 12 is a graph for explaining the method of adjusting the thickness of plating layers of the two surfaces.

For example, as shown by the point R1 of FIG. 12, when the polishing amount ΔT1 of the plating layer M1 which has become the thickness T1 is further from the polishing amount of 2 μm than the polishing amount ΔT2 of the plating layer M2 which has become the thickness T2 shown by the point R2. Further, when the thickness difference ΔT (=T1−T2) is outside the range of −0.15 μm to +0.15 μm, as shown by the one-dot broken line, the line passing through the origin and the point R1 is found and the rotational speed a3 of the point on the line and corresponding to the polishing amount of the point R2 is found. Further, the control signal C11 for lowering the upper platen 13 to the rotational speed a3 is output to the motor drive unit 35 to control the upper platen 13 (step S17 in FIG. 8).

Conversely, when the polishing amount ΔT2 is further from the polishing amount 2 μm than the polishing amount ΔT1, as shown by the two-dot broken line, the line passing through the origin and the point R2 is found and the rotational speed b3 on the line and corresponding to the polishing amount of R1 is found. Further, the control signal C22 for lowering the lower platen 11 to the rotational speed b3 is output to the motor drive unit 36 (step S17 in FIG. 8).

The motor drive unit 35 is a unit for driving the motor 18 based on the control signals C1 (or C1') and C11 from the upper platen rotational speed control unit 31 and the double-side thickness difference adjusting unit 34. The upper platen 13 rotates at a rotational speed indicated by these control signals.

The motor drive unit 36 is a portion for driving the motor 15 based on the control signals C2 (or C2') and C22 from the lower platen rotational speed control unit 32 and the double-side thickness difference adjusting unit 34. The lower platen 11 rotate at a rotational speed indicated by these control signals.

The motor drive unit 37 is a portion for driving the motor 16 for the internal gear 12. The motor drive unit 38 is a portion for driving the motor 14 for the sun gear 10.

The timer 39 is for making the motor drive units 35 to 38 operate for exactly the set time (3 minutes in this embodiment) and is controlled by the not shown system controller.

Specifically, in FIG. 1, when the 50 magnetic disks W are set in the carrier 19 of the double-side polishing apparatus 1 and the upper platen 13 presses against these magnetic disks W, the system controller turns the timer 39 on. Due to this, the motor drive units 35 to 38 operate for exactly 3 minutes. Further, the system controller is a known controller for controlling the operation of the system as a whole except for the X-ray thickness meter 2 and the control apparatus 3 such as the operations of the conveyors 6-1 and 6-2, the robot arms 7-1 and 7-2, the loader and unloader 4-1 and 4-2, and the washing apparatus 9, the elevating operation of the upper platen 13, and the on operation of the timer 39.

Next, an explanation will be given of the operation of the polishing amount control system of this embodiment.

In FIG. 1, when a cassette 5-1 storing one batch of magnetic disks W is conveyed by a conveyor 6-1*b*, the magnetic disks W are taken out by the robot arm 7-1 and placed on the carrying-in table 8-1. Next, the loader 4-1 descends, grips the magnetic disks W by the chucks 40, then rises and moves directly above the double-side polishing apparatus 1. The loader 4-1 descends toward the lower platen 11, places the gripped magnetic disks W in the workpiece holding holes 19*a* of the carrier 19 on the lower platen 11, then again rises and moves above the carrying-in table 8-1.

Next, when the upper platen 13 descends toward the lower platen 11, the magnetic disks W are pressed against by a predetermined force, and the timer 39 of the control apparatus 3 is turned on. The motors 14 to 16 and 18 operate, the plating layers M1 and M2 of the magnetic disks W are polished by the polishing pads 13*a* and 11*a* of the upper platen 13 and lower platen 11, and thereby a double-side polishing step is executed.

After 3 minutes pass, the motors 14 to 16 and 18 are stopped. When one batch's worth of the double-side polishing step is finished, the upper platen 13 rises. The unloader 4-2 reaches directly above the lower platen 11, descends, grips the polished magnetic disks W by the chucks 40, then moves toward the carrying-out table 8-2 side.

In parallel with this, the magnetic disks W are arranged on the carrying-in table 8-1 by the robot arm 7-1 and the magnetic disks W are gripped and conveyed by the loader 4-1. The magnetic disks W are then set in the workpiece holding holes 19*a* of the carrier 19 of the double-side polishing apparatus 1.

On the other hand, the unloader 4-2 descends when reaching directly above the carrying-out table 8-2 and arranges the gripped magnetic disks W on the carrying-out table 8-2. Next, the magnetic disks W on the carrying-out table 8-2 are successively sent by the robot arm 7-2 to the washing apparatus 9. The magnetic disks W washed by the washing apparatus 9 are stored in an empty cassette 5-2 on the conveyor 6-2*a*.

This cassette 5-2 is moved from the conveyor 6-2*a* to the conveyor 6-2*b*. When reaching directly beneath the X-ray thickness meter 2, the conveyor 6-2*b* stops and the 50th magnetic disk W in the cassette 5-2 is picked up by suction by the lever 61 of the push-up unit 60.

When the magnetic disk W is picked up by suction by the chuck 20 of the X-ray thickness meter 2, the thickness measurement step is performed. That is, the X-ray thickness meter body 2*a* of the X-ray thickness meter 2 is actuated, the thicknesses of the plating layers M1 and M2 of the magnetic disk W are measured, and the voltages V1 and V2 indicating the thicknesses T1 and T2 of the plating layers M1 and M2 are output to the control apparatus 3.

Next, the control step is proceeded to and the different processes are executed.

That is, at the upper platen rotational speed control unit 31 and the lower platen rotational speed control unit 32, the polishing amounts ΔT1 and ΔT2 are found and it is judged if these are within the allowable range of the polishing amount of 1.8 μm to 2.2 μm. At first, the conditions of the polishing pads 13*a*, 11*a*, etc. do not change, so the polishing amounts ΔT1 and ΔT2 are within the range of 1.8 μm to 2.2 μm and the polishing amounts ΔT1 and ΔT2 are output to the double-side thickness difference adjusting unit 34. Further, in the double-side thickness difference adjusting unit 34, the thickness difference ΔT is found and it is judged if the thickness difference ΔT is within the allowable range of the thickness difference of −0.15 μm to +0.15 μm. When the thickness difference ΔT is within the range of −0.15 μm to +0.15 μm, no control signal is output from the double-side thickness difference adjusting unit 34.

When the polishing work of the double-side polishing apparatus 1 is repeated, however, the polishing pads 13*a* and 11*a* become worn and the polishing conditions of the double-side polishing apparatus 1 change. Even if the polishing amount ΔT1 and the polishing amount ΔT2 are within the range of 1.8 μm to 2.2 μm, the thickness difference ΔT falls out of the range of −0.15 μm to +0.15 μm.

In this case, as explained above, the control signal C11 or control signal C22 is output from the double-side thickness difference adjusting unit 34 to the motor drive unit 35 or motor drive unit 36. As a result, the rotational speed of the upper platen 13 or the lower platen 11 changes at the time of the next polishing work of the double-side polishing apparatus 1 and the thickness difference ΔT between the thickness T1 of the plating layer M1 of the magnetic disk W and the thickness T2 of the plating layer M2 becomes substantially zero (double-side thickness difference adjusting step).

Further, when the polishing conditions remarkably deteriorate and the polishing amount ΔT1 of the plating layer M1 or the polishing amount ΔT2 of the plating layer M2 deviate from the range of 1.8 μm to 2.2 μm, as explained above, the control signal C1 (or C1') is output from the upper platen rotational speed control unit 31 to the motor drive unit 35 and the control signal C2 (or C2') is output from the lower platen rotational speed control unit 32 to the motor drive unit 36. As a result, the upper platen 13 or lower platen 11 rotate by a rotational speed indicated by the control signal with respect to the magnetic disk W of the next polishing and the polishing amounts ΔT1 and ΔT2 at the plating layers M1 and M2 of the magnetic disk W of the next polishing are made to fall in the range of 1.8 μm to 2.2 μm (upper and lower platen rotational speed control step).

In this way, according to the polishing amount control system of this embodiment, the results of the measurement by the X-ray thickness meter 2 are immediately fed back to the motors 15 and 18 of the double-side polishing apparatus 1, so the wait time in the magnetic disk W of the next polishing can become shorter and as a result it is possible to improve the productivity of the magnetic disks W.

Further, since the allowable range of the polishing amount is set to 1.8 μm to 2.2 μm, it is possible to reliably polish the plating layers M1 and M2 of the magnetic disks W flat.

Further, since the allowable range of the thickness difference is set to −0.15 μm to +0.15 μm, the thicknesses of the plating layers M1 and M2 become substantially equal and it is possible to produce magnetic disks W with high properties.

Second Embodiment

Figure 13:
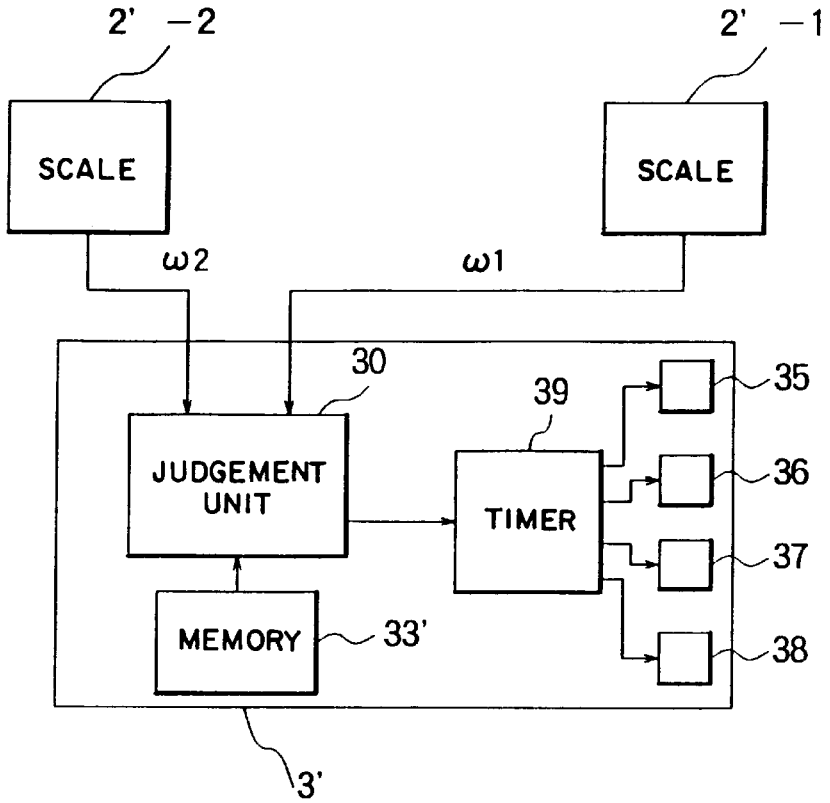
FIG. 13 is a block diagram of essential portions of a polishing amount control system according to a second embodiment of the invention.

FIG. 13 is a block diagram of essential portions of a polishing amount control system according to a second embodiment of the invention.

The polishing amount control system of this embodiment differs from the first embodiment in the point of control of the polishing time of the double-side polishing apparatus 1 in accordance with the difference between the weight of the magnetic disk W before polishing and the weight of the magnetic disk W after polishing.

In FIG. 13, the scale 2'-1 is a meter for measuring the total weight of one batch's worth of magnetic disks before polishing by the double-side polishing apparatus 1. This measured weight ω1 is input to a judgement unit 30 of the control apparatus 3'. On the other hand, the scale 2'-2 is a meter for measuring the total weight of one batch's worth of the magnetic disks W after polishing by the double-side polishing apparatus 1 and washing by the washing apparatus 9. The measured weight ω2 is input to the judgement unit 30.

The scales 2'-1 and 2'-2, as shown by the broken lines in FIG. 1, are provided near the starting end of the conveyor 6-1*b* and near the ending end of the conveyor 6-2*a* and measure the weights of the magnetic disks W in the cassettes 5-1 and 5-2 transferred by a not shown transfer apparatus.

The judgement unit 30 of the control apparatus 3' is a portion for judging the polishing time of the double-side polishing apparatus 1 in accordance with the weight difference Δω between the measured weight ω1 from the scale 2'-1 and the measured weight ω2 from the scale 2'-2.

Next, an explanation will be given of the method of judging the polishing time by the judgement unit 30 based on FIG. 14 and FIG. 15.

For example, in the initial state where the polishing pads 13*a* and 11*a* of the upper platen 13 and the lower platen 11 are normal, when the timer 39 is set to 3 minutes, a magnetic disk W is polished by exactly a desired amount and the weight difference Δω is 10 g.

Figure 14:
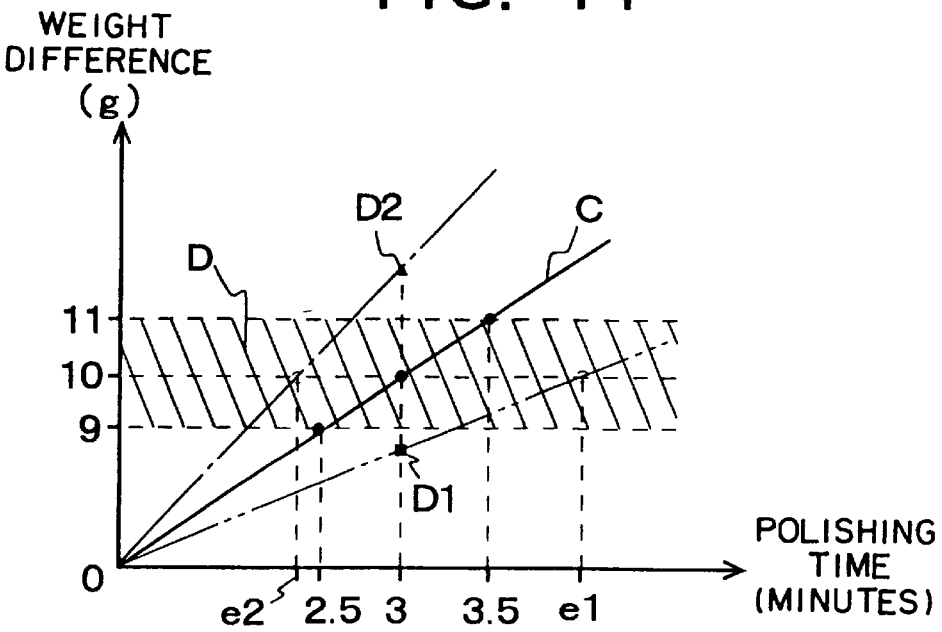
FIG. 14 is a graph for explaining a method of judging a polishing time by a judgement unit.

Under these conditions, the correspondence between the polishing time and the weight difference Δω becomes the solid line C shown in FIG. 14, so this relationship is tabularized and stored in the memory 33'. Specifically, the target value of the weight difference Δω when polishing 50 magnetic disks W for 3 minutes is for example made 10 g and, considering an error or plus or minus 10%, the allowable range of the weight D is set to 9 to 11 g. In this state, when the polishing time for making the weight difference Δω 9 g is 2.5 minutes and the polishing time for making the weight difference Δω11 g is 3.5 minutes, as shown by the hatching, a value between the weight difference 9 g of the 2.5 minutes polishing time and the weight difference 11 g of the 3.5 minutes polishing time is stored in the memory 33' as the allowable range of the weight D.

Figure 15:
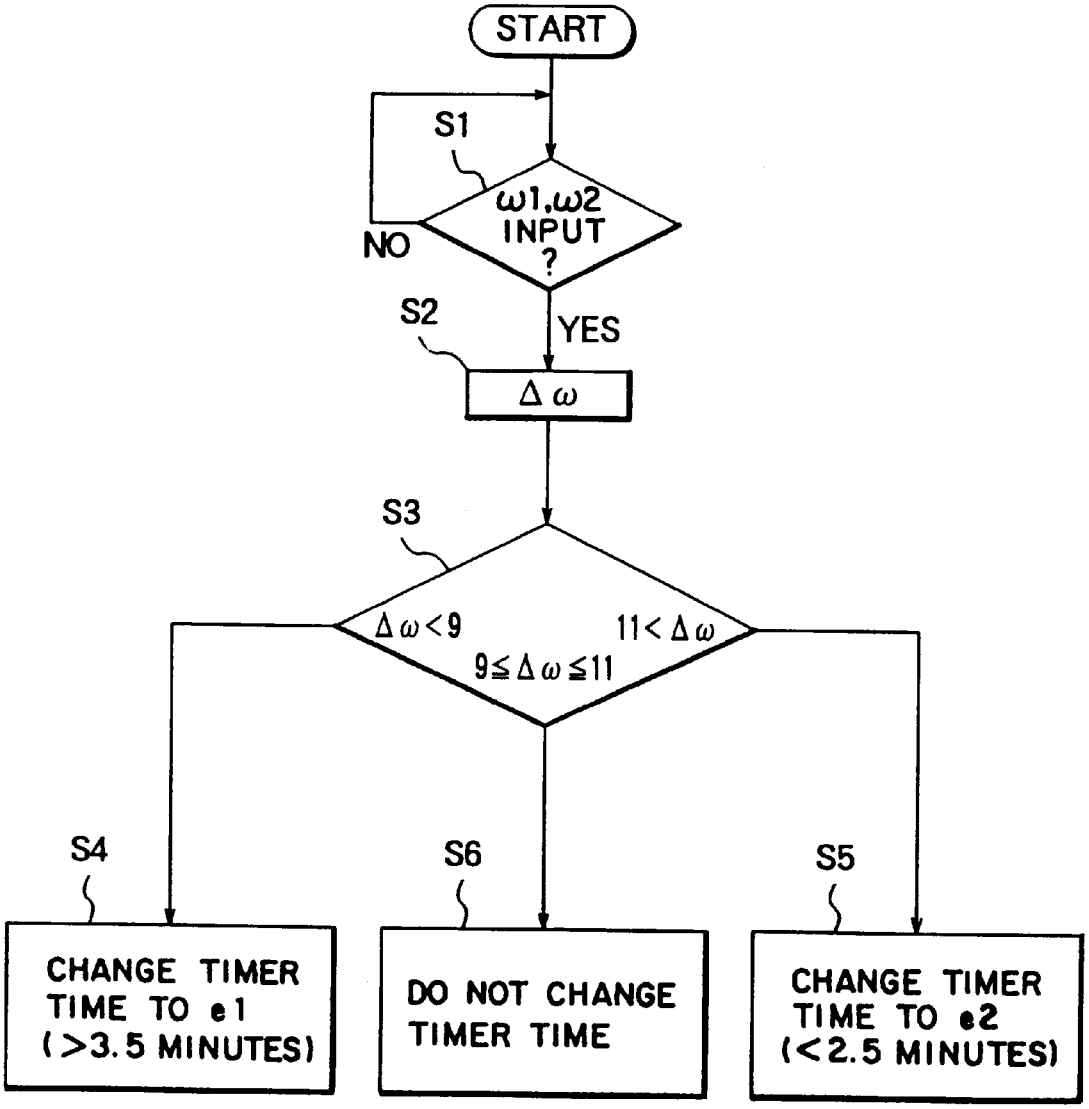
FIG. 15 is a flow chart for explaining a method of judging a polishing time by a judgement unit.

Next, the judgement unit 30 computes the weight difference Δω of the measured weights ω1 and ω2 from the scales 2'-1 and 2'-2 (steps S1 and S3 of FIG. 15). Further, when the weight difference Δω, as shown by the point D1, is smaller than the allowable range of weight D, as shown by the two-dot broken line, the line passing through the origin and the point D1 is found and the time e1 (>3.5 minutes) giving a weight difference Δω of 10 g on the line is found. The timer 39 is changed to this time e1 (steps S3 and S4 in FIG. 15).

Further, when the weight difference Δω, as shown by the point D2, is larger than the allowable range of weight D, as shown by the one-dot broken line, the line passing through the origin and the point D2 is found and the time e2 (>2.5 minutes) giving a weight difference Δω of 10 g on the line is found. The timer 39 is changed to this time e2 (steps S3 and S5 in FIG. 15).

Note that, while natural, when the weight difference Δω is within the allowable range of weight D, the timer 39 is not changed (steps S3 and S6 in FIG. 15).

By this configuration, when the polishing conditions of the double-side polishing apparatus 1 change due to roughening of the polishing pads 13*a* and 11*a* of the upper platen 13 and lower platen 11 and the weight difference Δω of the measured weights ω1 and ω2 from the scales 2'-1 and 2'-2 is out of the above allowable range of weight D, the setting of the timer 39 is changed by the judgement unit 30. As a result, the operating time of the motor drive units 35 to 38 change, the polishing work time of the double-side polishing apparatus 1 changes, and the magnetic disk W of the next polishing is polished by exactly the desired polishing amount.

The rest of the configuration, mode of operation, and effects are similar to those of the first embodiment so explanations thereof are omitted.

Note that the present invention is not limited to the above embodiment. Various modifications and changes may be made within the scope of the gist of the invention.

For example, in the above embodiment, use was made of the double-side polishing apparatus 1 as a polishing apparatus, but of course a similar effect can also be obtained even if using the double-side polishing apparatus as a lapping apparatus.

In the above first embodiment, the X-ray thickness meter 2 measured the 50th magnetic disk W, but it is also possible to measure any one of the first to 49th magnetic disks W. Further, it is also possible to measure a plurality of magnetic disks W and input the average values of the thicknesses of the measured plurality of magnetic disks W as the voltages V1 and V2 to the upper platen rotational speed control unit 31 and the lower platen rotational speed control unit 32 of the control apparatus 3. Further, in this embodiment, it was assumed that the thickness of the plating layers M1 and M2 before polishing was a constant value T, but as shown by the two-dot broken line of FIG. 2, it is possible to provide another X-ray thickness meter 2 above the conveyor 6-1*b*, measure the thickness of the magnetic disk W before polishing as well, input the results of measurement of the thicknesses of the plating layers M1 and M2 before polishing and the results of measurement of the thicknesses of the plating layers M1 and M2 after polishing to the upper platen rotational speed control unit 31 and the lower platen rotational speed control unit 32 of the control apparatus 3, and compute the difference of the results of measurement to obtain high precision polishing amounts ΔT1 and ΔT2.

In the above first embodiment, the allowable range of the polishing amount was set to −1.8 μm to 2.2 μm and the allowable range of the thickness difference was set to −0.15 μm to +0.15μm, but this is to ensure the flatness of the plating layers and reduce the thickness difference of the two plating layers. Accordingly, if possible to secure flatness of the plating layers, the allowable range of the polishing amount may be set freely within the range of 1 μm to 5 μm. For example, it is possible to set the target value of the polishing amount to 3 μm and, considering an error of plus or minus 10%, to set the allowable range of the polishing amount to 2.7 μm to 3.3 μm. Further, it is possible to set the allowable range of the polishing amount to about 2 μm and the allowable range of the thickness difference to about 0 μm or other constant values. Further, other types of workpieces are not limited to the values of the allowable range of the polishing amounts or the allowable range of the thickness difference in the above embodiment. The values may be suitably set in consideration of the flatness of the surface of the workpieces and the thickness difference between surfaces.

The first embodiment was configured to control the rotational speeds of just the upper platen 13 and lower platen 11, but the point is to control the relative rotational speed of the upper platen 13 or the lower platen 11 with respect to the magnetic disk W. Accordingly, it is possible to obtain the desired relative rotational speed by controlling the rotational speeds of the sun gear 10, internal gear 12, upper platen 13, and lower platen 11.

Further, in the second embodiment, the allowable range of the weight D was set to 9 g to 11 g, but the invention is not limited to this.

As explained in detail above, according to the aspects of the invention, the results of the measurement of thickness are immediately fed back to the polishing work of the next workpiece, so it is possible to improve the productivity of the workpieces.

Further, it is possible to measure the thickness of a workpiece coating layer with a high precision.

Further, the polishing amount of an Ni-P plating layer is controlled so the polishing amount of the workpiece next polished becomes within the allowable range of the polishing amount of 1 μm to 5 μm, so it is possible to secure flatness of the plating layer. Also, it is controlled so the thickness difference of the two plating layers falls within the allowable range of the thickness difference of −0.15 μm to +0.15 μm, so high precision polishing with almost no difference between the two plating layers becomes possible.

Further, the results of the measurement of the weight are immediately fed back to the next workpiece polishing work, so it is possible to improve the productivity of the workpieces.

What is claimed is:

1. A polishing amount control system comprising:

a double-side polishing apparatus for making at least one of a sun gear and internal gear rotate so as to make a carrier holding a workpiece having a coating layer on each of the upper and lower surfaces of its substrate rotate and revolve around the sun gear and so as to polish a lower surface coating layer and an upper surface coating layer of the workpiece by a rotating lower platen and an upper platen rotating while pressing against the workpiece;

a thickness measurement apparatus for measuring the thicknesses of the upper surface coating layer and the lower surface coating layer after polishing by said double-side polishing apparatus; and a control apparatus for controlling the rotational speeds of the upper platen and lower platen of said double-side polishing apparatus in accordance with the thicknesses of the upper surface coating layer and lower surface coating layer measured by said thickness measurement apparatus, wherein the control apparatus comprises:

an upper platen rotational speed control unit for computing an upper film polishing amount comprising a difference between a thickness of the upper surface coating layer before polishing of the workpiece and a thickness of the upper surface coating layer after polishing measured by said thickness measurement apparatus, outputting a value of the upper surface coating layer after polishing when the upper film polishing amount is within a predetermined allowable range of the polishing amount, raising the rotational speed of the upper platen with respect to the workpiece so that the upper film polishing amount becomes within the allowable range of the polishing amount when the upper film polishing amount is smaller than the allowable range of the polishing amount, and conversely lowering the rotational speed of the upper platen with respect to the workpiece so that the upper film polishing amount becomes within the allowable range of the polishing amount when the upper film polishing amount is larger than the allowable range of the polishing amount;

a lower platen rotational speed control unit for computing a lower film polishing amount comprising a difference between a thickness of the lower surface coating layer before polishing of the workpiece and a thickness of the lower surface coating layer after polishing measured by said thickness measurement apparatus, outputting a value of the lower surface coating layer after polishing when the lower film polishing amount is within a predetermined allowable range of the polishing amount, raising the rotational speed of the lower platen with respect to the workpiece so that the lower film polishing amount becomes within the allowable range of the polishing amount when the lower film polishing amount is smaller than the allowable range of the polishing amount, and conversely lowering the rotational speed of the lower platen with respect to the workpiece so that the lower film polishing amount becomes within the allowable range of the polishing amount when the lower film polishing amount is larger than the allowable range of the polishing amount; and a double-side thickness difference adjusting unit for controlling the rotational speed of at least one of the upper platen and lower platen so that the difference of thickness of the two surfaces of the workpiece at the next polishing becomes within the allowable range of thickness when the difference of thickness of the two surfaces, comprising the difference between the value of the upper surface coating layer from said upper platen rotational speed control unit and the value of the lower surface coating layer from said lower platen rotational speed control unit is outside a predetermined allowable range of the thickness.

2. A polishing amount control system as set forth in claim 1, wherein said thickness measurement apparatus is an X-ray thickness meter.

3. A polishing amount control system as set forth in claim 1, wherein the workpiece is a magnetic disk having a nickel-phosphorus plated layer as a coating layer on each of the upper and lower surfaces of a magnetic disk substrate.

4. A polishing amount control system as set forth in claim 3, wherein the allowable range of the polishing amount is 1 μm to 5 μm and the allowable range of the difference of thickness is −0.15 μm to +0.15 μm.

5. A polishing amount control system comprising:

a double-side polishing apparatus for polishing both surfaces of a workpiece;

a weight measurement apparatus for measuring the weight of a workpiece after polishing by said polishing apparatus; and a control apparatus for controlling the polishing time of said polishing apparatus in accordance with the weight measured by said weight measurement apparatus, wherein said control apparatus computes the difference in weight between the workpiece before polishing and the workpiece after polishing measured by said weight measurement apparatus, lengthens the polishing time of said polishing apparatus so that the difference of weight of the workpiece at the next polishing becomes within an allowable range of the weight when the difference of weight is smaller than a predetermined allowable range of weight, and conversely shortens the polishing time of said polishing apparatus so that the difference of weight at the next polishing becomes within the allowable range of the weight when the difference of weight is larger than the allowable range of weight.

6. A polishing amount control method comprising:

a double-side polishing step for simultaneously polishing a lower surface coating layer and an upper surface coating layer of a workpiece by a double-side polishing apparatus;

a thickness measurement step for measuring the thicknesses of the upper surface coating layer and the lower surface coating layer of the workpiece after the double-side polishing step; and a control step for controlling the rotational speeds of the upper platen and lower platen of the double-side polishing apparatus in accordance with the thicknesses of the upper surface coating layer and lower surface coating layer measured by the thickness measurement apparatus, wherein the control step comprises:

an upper platen rotational speed control step for computing an upper film polishing amount comprising a difference between a thickness of the upper surface coating layer before polishing of the workpiece and a thickness of the upper surface coating layer after polishing measured in said thickness measurement step, outputting a value of the upper surface coating layer after polishing when the upper film polishing amount is within a predetermined allowable range of the polishing amount, raising the rotational speed of the upper platen with respect to the workpiece so that the upper film polishing amount becomes within the allowable range of the polishing amount when the upper film polishing amount is smaller than the allowable range of the polishing amount, and conversely lowering the rotational speed of the upper platen with respect to the workpiece so that the upper film polishing amount becomes within the allowable range of the polishing amount when the upper film polishing amount is larger than the allowable range of the polishing amount;

a lower platen rotational speed control step for computing a lower film polishing amount comprising a difference between a thickness of the lower surface coating layer before polishing of the workpiece and a thickness of the lower surface coating layer after polishing measured by said thickness measurement step, outputting a value of the lower surface coating layer after polishing when the lower film polishing amount is within a predetermined allowable range of the polishing amount, raising the rotational speed of the lower platen with respect to the workpiece so that the lower film polishing amount becomes within the allowable range of the polishing amount when the lower film polishing amount is smaller than the allowable range of the polishing amount, and conversely lowering the rotational speed of the lower platen with respect to the workpiece so that the lower film polishing amount becomes within the allowable range of the polishing amount when the lower film polishing amount is larger than the allowable range of the polishing amount; and a double-side thickness difference adjusting step for controlling the rotational speed of at least one of the upper platen and lower platen so that the difference of thickness of the two surfaces of the workpiece at the next polishing becomes within the allowable range of thickness when the difference of thickness of the two surfaces, comprising the difference between the value of the upper surface coating layer output in said upper platen rotational speed control step and the value of the lower surface coating layer output at said lower platen rotational speed control step is outside a predetermined allowable range of the thickness.

7. A polishing amount control method as set forth in claim 6, wherein in said thickness measurement step, the thicknesses of the upper surface coating layer and the lower surface coating layer are measured by an X-ray thickness meter.

8. A polishing amount control method as set forth in claim 6, wherein in said double-side polishing step, a magnetic disk having a nickel-phosphorus plated layer as a coating layer on each of the upper and lower surfaces of a magnetic disk substrate is polished.

9. A polishing amount control method as set forth in claim 8, wherein in said upper platen rotational speed control step and in said lower platen rotational speed control step, an allowable range of the polishing amount of 1 μm to 5 μm is set and in said double-side thickness difference adjusting step, an allowable range of the difference of thickness of −0.15 μm to +0.15 μm is set.

10. A polishing amount control method comprising:

a double-side polishing step for polishing both surfaces of a workpiece by a double-side polishing apparatus;

a weight measurement step for measuring the weight of a workpiece after said double-side polishing step; and a control step for controlling the polishing time of the polishing apparatus in accordance with the weight measured by said weight measurement step, wherein said control step computes the difference in weight between the workpiece before polishing and the workpiece after polishing measured at said weight measurement step, lengthens the polishing time of the polishing apparatus so that the difference of weight of the workpiece at the next polishing becomes within an allowable range of the weight when the difference of weight is smaller than a predetermined allowable range of weight, and conversely shortens the polishing time of the polishing apparatus so that the difference of weight at the next polishing becomes within the allowable range of the weight when the difference of weight is larger than the allowable range of weight.

* * * * *